US007798587B2

(12) United States Patent
Mizes et al.

(10) Patent No.: US 7,798,587 B2
(45) Date of Patent: Sep. 21, 2010

(54) SYSTEM AND METHOD FOR CROSS-PROCESS CONTROL OF CONTINUOUS WEB PRINTING SYSTEM

(75) Inventors: Howard Mizes, Pittsford, NY (US); R. Enrique Viturro, Rochester, NY (US); Kenneth R. Ossman, Macdeon, NY (US); Roger Leighton, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 69 days.

(21) Appl. No.: 12/372,294

(22) Filed: Feb. 17, 2009

(65) Prior Publication Data

US 2010/0209160 A1 Aug. 19, 2010

(51) Int. Cl.
*B41J 25/308* (2006.01)

(52) U.S. Cl. ..... 347/8; 347/9; 347/16

(58) Field of Classification Search ..... 347/8
See application file for complete search history.

(56) References Cited

U.S. PATENT DOCUMENTS 2,686,453 A 8/1954 Bogert
4,322,044 A 3/1982 Bilek
5,209,589 A * 5/1993 Bliss ..... 400/568
5,458,062 A 10/1995 Goldberg et al.
5,729,817 A 3/1998 Raymond et al.
6,633,740 B2 10/2003 Estabrooks
7,056,048 B2 6/2006 Braun et al.
2002/0023558 A1 2/2002 Kusunoki
2007/0229562 A1 10/2007 Doherty et al.
2008/0252675 A1 * 10/2008 Yasutani et al. ..... 347/16

* cited by examiner

*Primary Examiner*—Matthew Luu
*Assistant Examiner*—Brian J Goldberg
(74) *Attorney, Agent, or Firm*—Maginot, Moore & Beck LLP

(57) ABSTRACT

A system and method for controlling the cross-process position of ink print heads including identifying a first roll error frequency related to a circumference of a first roll, identifying a first roll error phase with respect to a reference location along a process path, identifying a first roll error amplitude of cross-process motion, identifying a second roll error frequency related to a circumference of a second roll, identifying a second roll error phase with respect to the reference location, identifying a second roll error amplitude of cross-process motion, and controlling the cross-process position of a first and second print head based upon the identified first roll error frequency, first roll error phase, first roll error amplitude, second roll error frequency, second roll error phase, and second roll error amplitude, wherein the first print head is axially spaced apart from the second print head along the process direction.

20 Claims, 5 Drawing Sheets

SYSTEM AND METHOD FOR CROSS-PROCESS CONTROL OF CONTINUOUS WEB PRINTING SYSTEM

BACKGROUND

The system and method disclosed herein relates to printing systems that generate images onto continuous web substrates. In particular, the disclosed embodiments relate to control of the cross-process control of printheads in such systems.

Printers provide fast, reliable, and automatic reproduction of images. The word "printer" as used herein encompasses any apparatus, such as a digital copier, book marking machine, facsimile machine, multi-function machine, etc., which performs a print outputting function for any purpose. Printing features that may be implemented in printers include the ability to do either full color or black and white printing, and printing onto one (simplex) or both sides of the image substrate (duplex).

Some printers, especially those designed for very high speed or high volume printing, produce images on a continuous web print substrate. In these printers, the image substrate material is typically supplied from large, heavy rolls of paper upon which an image is printed instead of feeding pre-cut sheets from a bin. The paper mill rolls can typically be provided at a lower cost per printed page than pre-cut sheets. Each such roll provides a very large (very long) supply of paper printing substrate in a defined width. Fan-fold or computer form web substrates may be used in some printers having feeders that engage sprocket holes in the edges of the substrate.

Typically, with web roll feeding, the web is fed off the roll past one or more printhead assemblies that eject ink onto the web, and then through one or more stations that fix the image to the web. A printhead is a structure including a set of ejectors arranged in at least one linear array of ejectors, for placing marks on media according to digital data applied thereto. Printheads may be used with different kinds of ink jet technologies, such as liquid ink jet, phase-change ink, systems that eject solid particles onto the media, etc.

Thereafter, the web may be cut in a chopper and/or slitter to form copy sheets. Alternatively, the printed web output can be rewound onto an output roll (uncut) for further processing offline. In addition to cost advantages, web printers can also have advantages in feeding reliability, i.e., lower misfeed and jam rates within the printer as compared to high speed feeding of precut sheets through a printing apparatus.

A further advantage is that web feeding from large rolls requires less downtime for paper loading. For example, a system printing onto web paper supplied from a 5 foot diameter supply roll is typically able to print continuously for more than an hour at speeds of about 500 feet per minute (fpm) without requiring any operator action. Printers using sheets, which usually print at speeds of about 100 fpm, may require an operator to re-load cut sheet feeders 2 to 3 times per hour. Continuous web printing also provides greater productivity for the same printer processing speed and corresponding paper or process path velocity through the printer, since web printing does not require pitch space skips between images as is required between each sheet for cut sheet printing.

To achieve the high speeds desired in continuous web printing and to cover the width of the web as required in production printing, multiple printheads are used. As the printer operates, the printheads expand and contract in response to changing thermal conditions. Thus, the width covered by a particular printhead (the "extent" of the printhead) varies depending on the operating temperature. Likewise, the rolls used to define the process path expand and contract in response to temperature changes. The expansion and contraction of the rolls affects the alignment of the process path. Likewise, the paper media expands and contracts as moisture leaves the paper at varying rates as the local temperature changes throughout the process. "Alignment" as used herein, unless otherwise expressly qualified, is defined as the location of the printhead along the width of the process path immediately adjacent to the printhead (cross-process location), and the orientation of the cross-process axis of the printhead with respect to an axis perpendicular to the edge of the process path. Thus, the web, which is designed to move perpendicularly past each of the printheads along the in-track axis of the process path, may move past a printhead at a skewed angle or may be displaced in the cross process direction when the printhead is misaligned with respect to the web. Additionally, the cross-process extent of the printhead may not be positioned properly with respect to the other printheads.

Misalignment resulting from movement of the printheads and the rolls is exacerbated by the positioning of printheads for different colors at different locations along the in-track axis of the process path. Specifically, printers that generate color copies may include one or more printheads for each color of ink used in the printer. Each of the printheads associated with the different colors is positioned at a location along the in-track axis of the process path that may be separated from other printheads by one or more roll pairs. Each roll pair produces a unique alignment of the media with respect to the process path. Accordingly, changes in the printheads and rolls may cause the printheads to be misaligned with the web as it moves along the process path.

Alignment of printheads to account for the changes caused by thermal expansion and contraction of the printheads (static alignment errors) is known. The correction of static alignment errors increases the clarity of images produced on the web. The clarity that can be obtained, however, is limited by the introduction of dynamic alignment errors, which are manifested during operation of the printing system. These dynamic errors are not corrected by the alignment of the printheads to account for thermal expansion and contraction of the printheads. Consequently, alignment procedures for printing systems, which reduce dynamic errors, would be beneficial.

SUMMARY

A system and method for controlling the cross-process position of ink print heads including identifying a first roll error frequency related to a circumference of a first roll, identifying a first roll error phase with respect to a reference location along a process path, identifying a first roll error amplitude of cross-process motion, identifying a second roll error frequency related to a circumference of a second roll, identifying a second roll error phase with respect to the reference location, identifying a second roll error amplitude of cross-process motion, and controlling the cross-process position of a first and second print head based upon the identified first roll error frequency, first roll error phase, first roll error amplitude, second roll error frequency, second roll error phase, and second roll error amplitude, wherein the first print head is axially spaced apart from the second print head along the process direction.

In accordance with another embodiment, a printing system includes a first roll with a first circumference positioned along a process path, a second roll with a second circumference positioned along the process path, the second circumference different from the first circumference, a first print head positioned adjacent to the process path, a second print head positioned adjacent to the process path and axially spaced apart from the first print head along an in-track axis of the process path, a sensor positioned along the process path, a memory in which command instructions are stored, and a processor configured to execute the command instructions to characterize the cross-process movement of a web moving along the in-track axis of the process path by (i) identifying a first roll error ($R_e$) associated with the first roll, (ii) identifying a second $R_e$ associated with the second roll, and (iii), calculating the cross-process web motion from the first roll error and the second roll error, control the cross-process position of the first print head based upon the calculated cross-process web motion, and control the cross-process position of the second print head based upon the calculated cross-process web motion.

In a further embodiment, a method of controlling a plurality of print heads includes identifying a first cross-process error associated with the location of a first mark in a registration pattern on a web moving along a process path, identifying a second cross-process error associated with the location of a second mark in the registration pattern, identifying a first roll frequency associated with a first roll positioned along the process path, identifying a second roll frequency associated with a second roll positioned along the process path, performing a first least squares fit analysis using the first roll frequency, the second roll frequency, the first cross-process error, and the second cross-process error to identify a compensation signal based upon a first roll error ($R_e$) associated with the first roll and a second roll error ($R_e$) associated with the second roll, and controlling the cross-process position of a first print head and a second print head based upon the identified compensation signal, wherein the first print head is axially spaced apart from the second print head along the in-track axis of the process path.

DESCRIPTION

Figure 1:
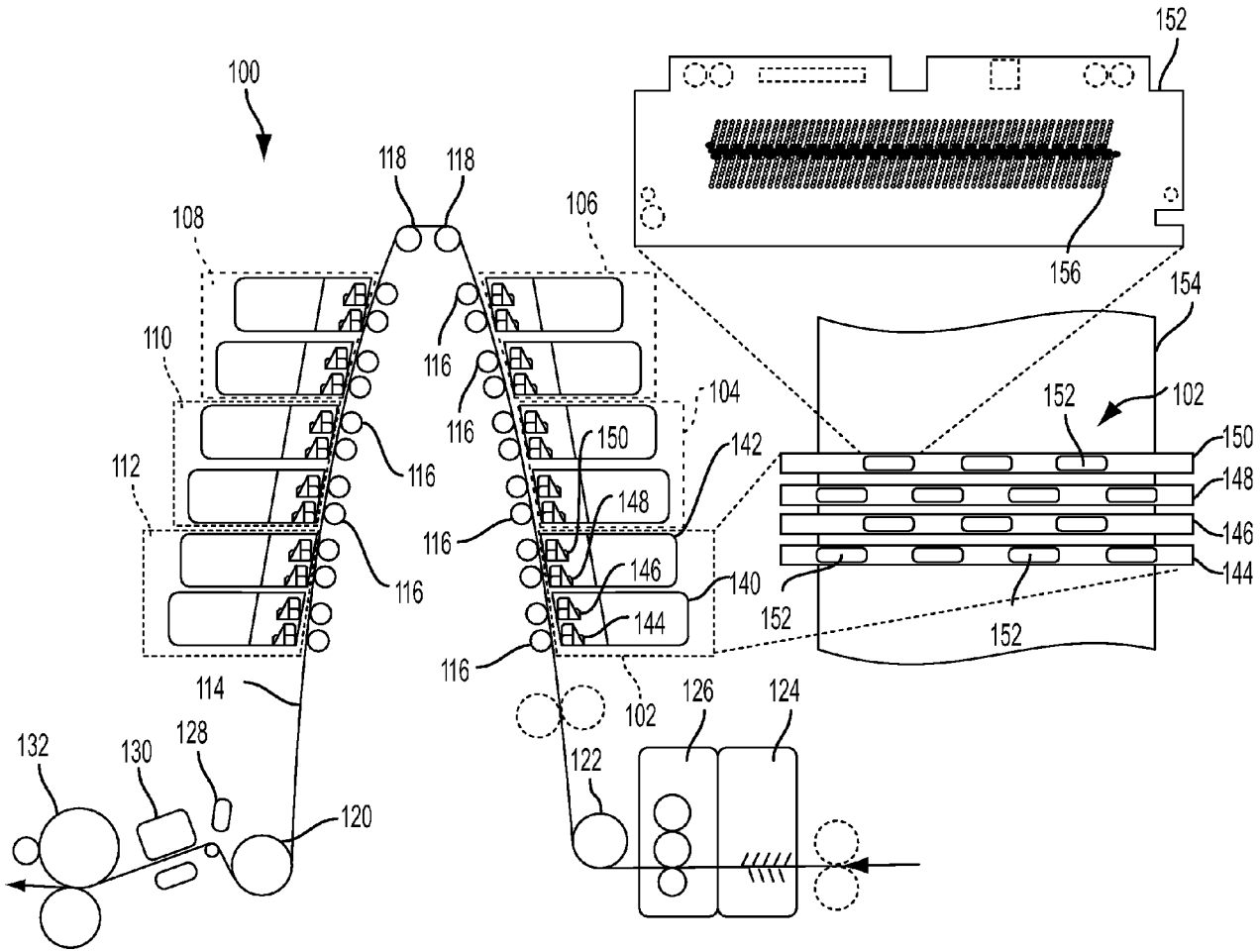
FIG. 1 depicts a schematic view of a continuous web printing system with twelve print modules along with expanded schematic views showing printheads positioned within print sub-modules and nozzles within a printhead.

With initial reference to FIG. 1, a continuous web printer system 100 includes six print modules 102, 104, 106, 108, 110, and 112. The print modules 102, 104, 106, 108, 110, and 112 are positioned sequentially along the in-track axis of a process path 114 defined in part by rolls 116. The process path 114 is further defined by upper rolls 118, leveler roll 120 and pre-heater roll 122. A brush cleaner 124 and a contact roll 126 are located at one end of the process path 114. An image on web array (IOWA) sensor 128, a heater 130 and a spreader 132 are located at the opposite end of the process path 114.

Each print module 102, 104, 106, 108, 110, and 112 in this embodiment provides an ink of a different color. In all other respects, the print modules 102, 104, 106, 108, 110, and 112 are substantially identical. Accordingly, while only print module 102 will be further described in detail, such description further applies to the print modules 104, 106, 108, 110, and 112.

Print module 102 includes two print sub modules 140 and 142. Print sub module 140 includes two print units 144 and 146 and print sub module 142 includes two print units 148 and 150. The print units 144 and 148 each include four print heads 152 while the print units 146 and 150 each include three printheads 152. Thus, each of the print sub modules 140 and 142 include seven offset printheads 152. The printheads 152 are offset to provide space for positioning of control components discussed more fully below. The use of multiple printheads 152 allows for an image to be printed on a web 154, which is much wider than an individual printhead 152. By way of example, seven print heads 152, which are each 3 inches wide, may be used to produce a 20.5 inch image on a web 154, which is 21 inches wide. Obviously, the print width of the exemplary print module 102 can be increased or decreased by adding or eliminating print heads to each two print sub modules.

Each of the print heads 152 in this embodiment includes sixteen rows of nozzles 156. Each of the nozzles 156 is individually controlled to jet a spot of ink on the web 154. The matrix of nozzles 156 in one embodiment provides a density of 300 nozzles per inch in the cross-process direction of the process path 114. Accordingly, each printhead 152 produces an image with a spot density of 300 spots of ink per inch (SPI).

The provision of two sub modules, such as sub modules 140 and 142, for each of the print modules 102, 104, 106, 108, 110, and 112 provides increased resolution. Specifically, the print heads 152 in the sub modules 142 are offset in the cross-process direction of the process path 114 with respect to the print heads 152 in the sub module 140 by a distance corresponding to the width of a spot or a pixel in a print head configured to provide 600 SPI. The resultant interlacing of the jets produced by the nozzles 152 generates an image with a 600 SPI resolution. Similarly, using this method, increasing printing resolutions can be achieved by utilizing single print heads of higher nozzle density.

Figure 2:
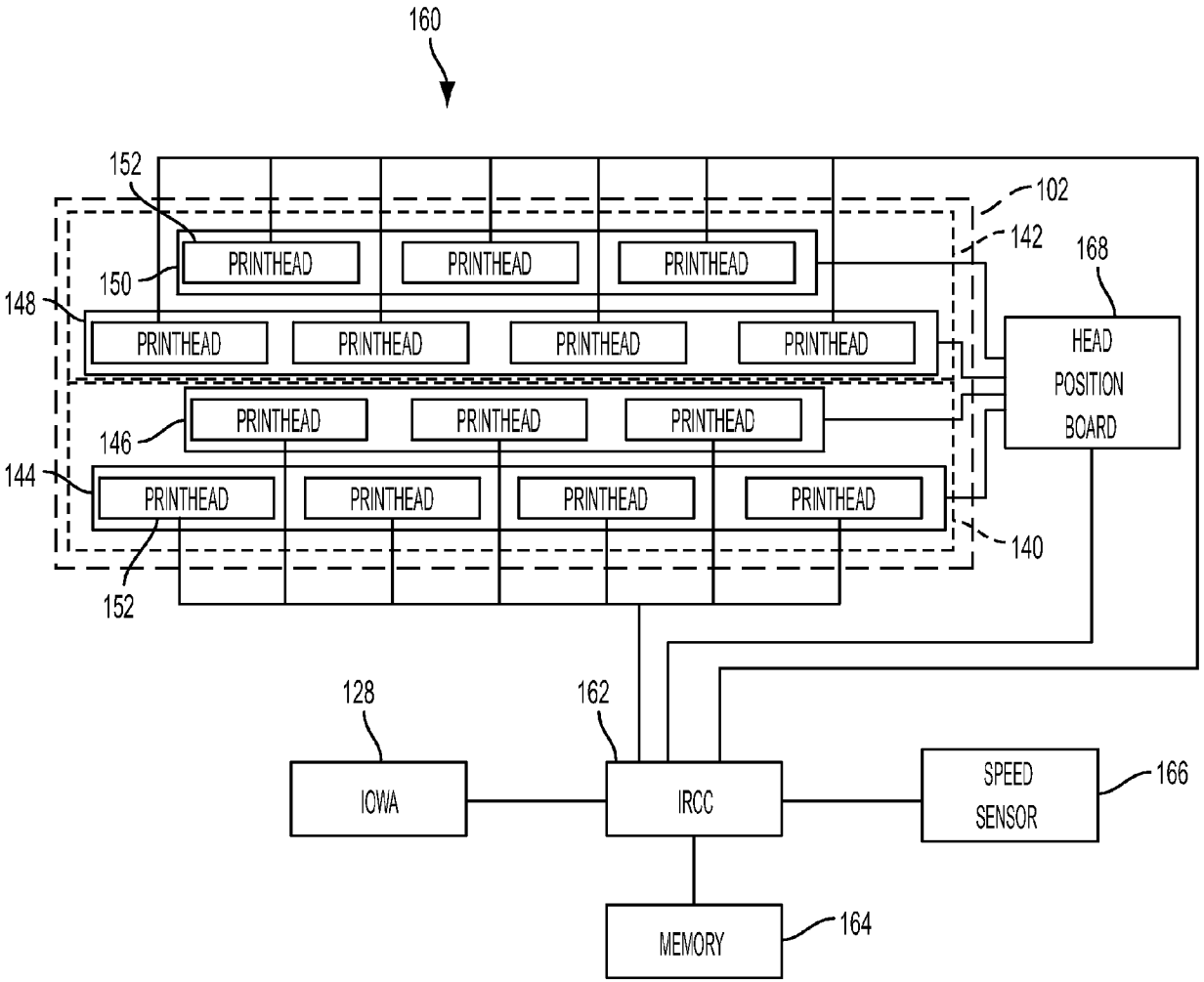
FIG. 2 depicts a schematic of a control system that may be used with the system of FIG. 1 to control generation and detection of registration patterns and to control the cross-process position of printheads to reduce dynamic errors.

Alignment of the print modules 102, 104, 106, 108, 110, and 112 with the process path 114 is controlled by a control system 160 shown in FIG. 2 (only print module 102 is shown in FIG. 2). The control system 160 includes an image registration and color control (IRCC) board 162 and a memory 164. The IRCC board 162 is connected to the IOWA sensor 128 and a speed sensor 166, which detects the speed at which the web 154 moves along the process path 114. The IRCC board 162 is further connected to each of the printheads 152 to control jetting of the nozzles 156, and a head position and roll board 168.

The IOWA sensor 128 is a full width image contact sensor, which monitors the ink on the web 154 as the web 154 passes under the IOWA sensor 128. When there is ink on the web 154, the light reflection off of the web 154 is low and when there is no ink on the web 154, the amount of reflected light is high. When a pattern of ink is printed by one or more of the printheads 152 under the control of the IRCC board 162, the IOWA sensor 128 may be used to sense the printed mark and provide a sensor output to the IRCC board 162.

Consequently, the IRCC board 162 is configured to control the nozzles 156 to produce registration marks, which are then sensed by the IOWA sensor 128. The IRCC board 162 uses the sensed position of the printed registration mark to determine the cross-process position of the nozzles 156 for the print modules 144, 146, 148, and 150 (along with the nozzles 156 within the print modules 104, 106, 108, 110, and 112). Based upon the relative positions, the IRCC board 162 determines cross-process position and roll corrections for the print units 144, 146, 148, and 150.

The IRCC board 162 passes data associated with the corrections to the head position and roll board 168, which in turn controls the cross-process position of the print units 144, 146, 148, and 150. The position of the print units 144, 146, 148, and 150 may be individually controlled using stepper motors configured to change the location of the associated print units 144, 146, 148, or 150 in one micron increments. Alternatively, piezoelectric motors may be used to reduce the potential for backlash when changing direction of the motors.

The control system 160 is sufficiently accurate to align the print units within the modules 102, 104, 106, 108, 110, and 112 both with respect to the web 154 and with respect to the other print modules 102, 104, 106, 108, 110, and 112 to reduce static errors to an acceptable level. This alignment results in proper interlacing of the nozzles 156 so as to realize a resolution of 600 SPI. High speed operation of the continuous web printer system 100, however, introduces dynamic errors, which exceed the cross-process spacing required between interlaced nozzles 156. Specifically, a resolution of 600 SPI requires control of the cross-process position of the nozzles 156 with an accuracy of less than 42 microns. Continuous web printer systems, such as the continuous web printer system 100, however, may exhibit cross process direction motion greater than 42 microns.

The inventors have discovered that movement of the web 154 in the cross-process direction is a significant contributor to the dynamic alignment errors between print units. The inventors have further discovered that manufacturing tolerances in the rolls used to define the process path are major contributors to the movement of the web 154 in the cross-process direction. This conclusion was verified by printing a long test pattern of dashed lines parallel to the direction of travel of the process path 114. The IOWA sensor 128 was then used to identify the position of the test pattern on the web 154.

Observations confirmed that the test patterns generated by each of the printheads 152 exhibited regular, cyclic errors and that the errors for each of the printheads 152 were of about the same magnitude and frequency, albeit phased differently for printheads 152 located in different print units (e.g., print units 144, 146, 148 and 150). A Fourier transform of the observed errors revealed distinct peaks, which occurred at spatial frequencies, which were determined to correspond to the circumferences of the rolls used to define the process path 114, e.g., rolls 116, upper rolls 118, the leveler roll 120 and the pre-heater roll 122.

Obtaining data sufficient to obtain reliable Fourier transform results during printing operations is problematic. As an initial matter, the web 154 is travelling along the process path 114 at a high speed. In one embodiment, the web 154 is travelling at a speed of 70 inches per second (ips). Accordingly, an exorbitant amount of material would be wasted in gathering the desired amount of data. Additionally, changes in operating characteristics of the system 100, including speed of the web 154 physical characteristics of the rolls, etc., would change the dynamic errors at a rate which could not be detected and corrected with sufficient timeliness to allow meaningful correction of the dynamic errors. Because the dynamic errors have been discovered to be predominantly associated with the rolls defining the process path 114, however, control of print unit position to compensate for dynamic errors may be performed rapidly using small data samples.

Figure 3:
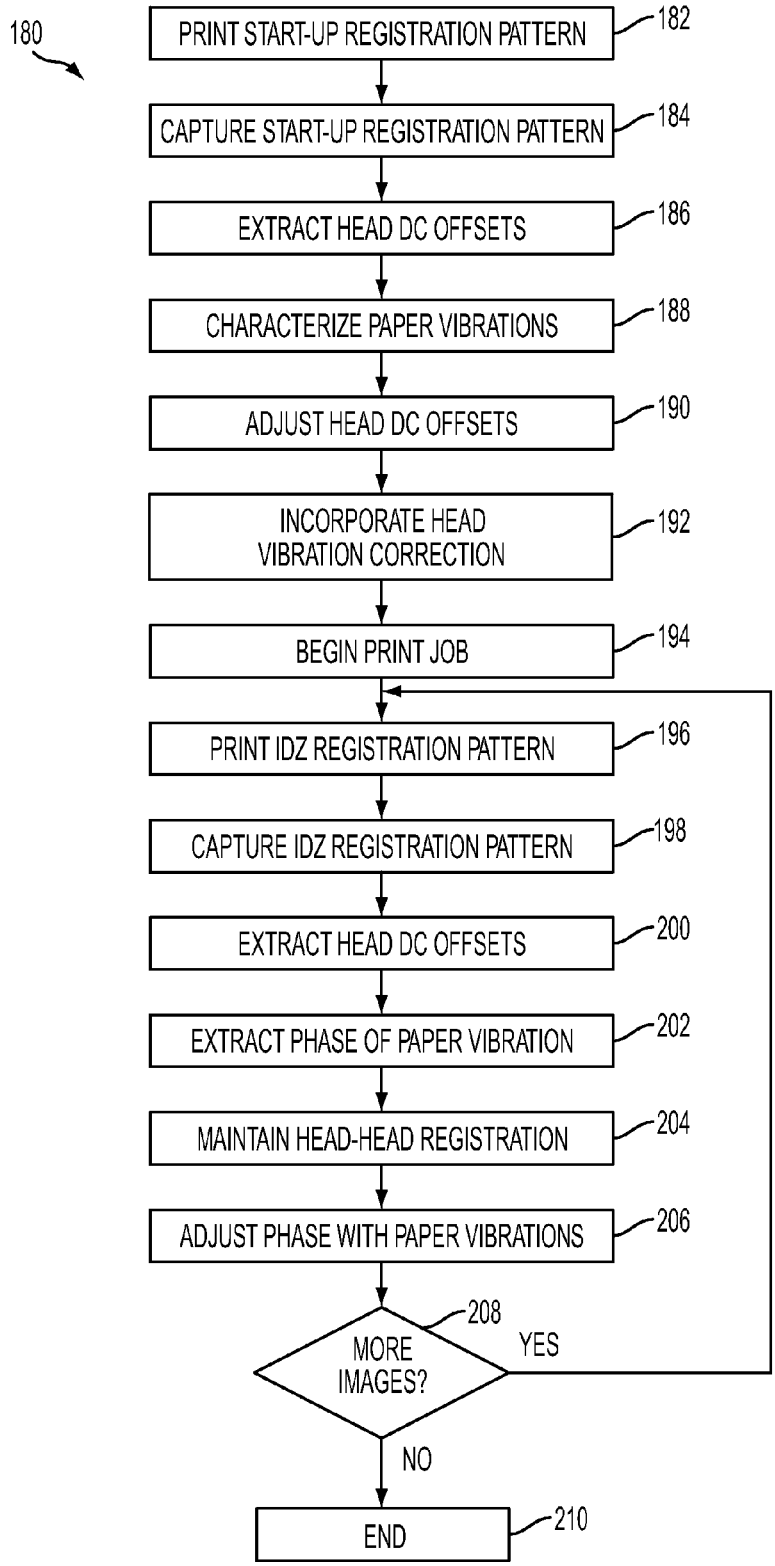
FIG. 3 depicts a flow diagram of a control procedure that may be performed by the control system of FIG. 2 to reduce static and dynamic cross-process errors.

In one embodiment, the memory 164 is programmed with command instructions which, when executed by the IRCC board 162, perform an alignment procedure 180 shown in FIG. 3, which may be used to correct dynamic errors. The alignment procedure 180 begins when the printer system 100 is energized and the IRCC board 162 controls the nozzles 156 to print a registration pattern on the web 154. More specifically, as the web 154 passes each of the print modules 102, 104, 106, 108, 110, and 112, a series of dashes is printed on a blank portion of the web 154 as that portion of the web 154 passes each of the respective print modules. The registration pattern may include a mark from each print unit in the system 100.

As the portion of the web 154 with the registration pattern approaches the IOWA sensor 128, the IOWA sensor 128 is energized. Timing of the energization of the IOWA sensor 128 may be based upon the speed of the web 154 sensed by the speed sensor 166 along with knowledge of the length of the process path 114 between the printheads 152 and the IOWA sensor 128.

As the registration pattern passes the IOWA sensor 128, the registration pattern is detected by the IOWA sensor 128 (block 184) and data indicative of the detected registration pattern are communicated to the IRCC board 162. The IRCC board 162 processes the data associated with the registration pattern to identify the nozzles 156 used to generate the registration pattern. The IRCC board 162 further uses the data associated with the registration pattern to identify cross-process position and roll of the respective print units with respect to a desired reference. The error between the identified cross-process position and a desired cross-process position with respect to the reference is then separated into a static error contribution and a dynamic error contribution (block 186). By way of example, if all of the print heads 152 in a print unit, such as print unit 144, are identically displaced, the error is most likely a dynamic error.

The error remaining after extraction of the static error (block 186) is the dynamic error. The IRCC board 162 analyzes the dynamic error to identify vibration amplitudes and phases contributing to cross-process movement of the web 154 (block 188). The analysis begins by identifying the frequencies associated with the rolls which define the process path 114. The time frequency for rolls of a given circumference may be obtained by dividing the speed of the web 154 by the circumference of the roll. Alternatively, a spatial frequency may be used by dividing the length of a segment of the process path by the circumference of the roll. The frequencies used in the process 180 may be preprogrammed into the memory 164.

A nonlinear least squares fit of the observed dynamic error using the known frequencies yields an amplitude and phase for each of the frequencies. This analysis provides a roll error ($R_e$) for each set of rolls with a common circumference, the $R_e$ for a given roll size being defined as follows:

$$R_e = A \sin\left(\frac{2\pi x}{D} + \varphi\right)$$

wherein $R_e$ is the combined roll error for all rolls of a given circumference, A is the calculated amplitude of the cross-process error, x is the position along the paper in the process direction, D is the diameter of the rolls which give the predetermined period of the dynamic error associated with the roll, and $\phi$ is the phase difference between the position of a particular printhead 152 that writes to the web 154 and the position of that particular printhead when the written image is sensed by the IOWA sensor 128.

The combined $R_e$ for each of the roll circumferences can be measured each time the web 154 passes under a print unit which is able to make a mark on the web. Typically, so long as the number of axially displaced sample points (i.e., print modules, print sub modules, or print units) exceeds the number of roll circumferences producing cross-process movement of the web 154, an $R_e$ may be generated for each roll circumference. As the ratio of axially displaced sample points to roll circumferences increases, the robustness of the amplitude and phase calculations increases.

The IRCC board 162 controls the print units 144, 146, 148, and 150 through the head position board 168 to correct the static errors which were extracted at block 186 (block 190). The IRCC board 162 further passes a dynamic correction to the head position board 168, which further controls the cross-process location of the print units 144, 146, 148, and 150 based upon the dynamic correction (block 192). In alternative embodiments, control may be implemented on at a print sub module or print module basis.

The dynamic correction reflects the superimposed roll errors determined at block 188 for all roll circumferences with the phase determined by the location of the print unit along the process path 114. Thus, while the head position board 168 controls the cross-process position of each of the print units 144, 146, 148, and 150 using a common compensating signal based upon the dynamic correction, the value of the signal at a given time is unique to the particular print unit 144, 146, 148, or 150. Thus, the cross-process position of the print units 144, 146, 148, and 150 are controlled to mimic the cross-process movement of the web 154 adjacent to the respective print unit 144, 146, 148, or 150 to reduce dynamic errors.

Depending upon the particular embodiment, the delay between transmission of data from the IRCC board 162 and receipt of the data by the head position board 168 introduced by the communication interface between the IRCC board 162 and the head position board 168 may introduce unacceptable delays in the transmission of $R_e$ data. So as to reduce transmission delays, an IEE 1394 (Firewire) connection may be provided between the IRCC board 162 and the head position board 168.

Once the print units 144, 146, 148, and 150 are being controlled by the head position board 168 to mimic the cross-process movement of the web 154, the print job begins (block 194). As the print job is executed, an interdocument zone (IDZ) is generated between subsequent images formed in the web 154. The IDZ, which is typically left blank, is used in the procedure 180 to print additional registration patterns during the print job (block 196). Each IDZ registration pattern is then captured by the IOWA sensor 128 (block 198).

The IRCC board 162 uses the data associated with the IDZ registration pattern to identify a modified static error contribution (block 200) and a modified dynamic error contribution (block 202) in substantially the same manner described above. One difference, however, results from the fact that the print units 144, 146, 148, and 150 used to generate the IDZ registration pattern were being controlled based upon the previously calculated dynamic error. If the amplitude and phase of the dynamic error contribution has drifted compared to an earlier measurement, its current value can be calculated from using the measured amplitude and phases and the compensating signals being written to the heads using the following:

$$a_p=\sqrt{a_m^2+a_c^2+2a_m a_c\cos(\phi_m-\phi_c)}$$

$$\varphi_p=\tan^{-1}\frac{a_m\sin\varphi_m+a_c\sin\varphi_c}{a_m\cos\varphi_m+a_c\cos\varphi_c}$$

wherein $a_c$ is the amplitude of the compensating motion of the heads in response to the cross-process dynamic errors, $\phi_c$ is the phase of the compensating motion of the heads, $a_m$ is the amplitude of the measured residual error which occurs when the compensating signal does not balance the paper motion error, $\phi_m$ is the phase of the measured residual error, $a_p$ is the amplitude of the paper motion for at the time the paper passed under the corresponding print head, $\phi_m$ is the phase of the paper motion, The IRCC board 162 then controls the print units 144, 146, 148, and 150 through the head position board 168 to correct the static errors, which were extracted at block 202 (block 204), and passes the modified dynamic correction to the head position board 168, which further controls the cross-process location of the print units 144, 146, 148, and 150 based upon the dynamic correction (block 206). If additional images are to be printed in the print job (block 208) the procedure 180 returns to block 196 and another IDZ registration pattern is printed. Otherwise, the procedure 180 ends (block 210).

The alignment procedure 180 was validated by modeling the continuous web printer system 100. In the model, the distance between the print modules 106 and 108 was set at 500 millimeters (mm) while the distance between the print units in each of the remaining pairs of modules was set at 106.38 mm. The distance between the print module 112 and the IOWA sensor 128 was set at 800 mm. Thus, the length of the process path 114 between the print unit 144 and the IOWA sensor 128 was 3640.36 mm.

The circumferences of the rolls 116, the upper rolls 118, and both of the leveler roll 120 and the preheater roll 122, were set at 340 mm, 420 mm, and 550 mm, respectively. The rolls 116 were modeled to generate a small circumference roll vibration with an amplitude of 40 microns, the upper rolls 118 were modeled to generate a medium circumference roll vibration with an amplitude of 60 microns, and the leveler roll 120 and the preheater roll 122 were modeled to generate a large circumference roll vibration with an amplitude of 20 microns. The phase of the small, medium, and large circumference roll vibrations with respect to the IOWA sensor 128 was set at −45°, 120°, and 15°, respectively.

Figure 4:
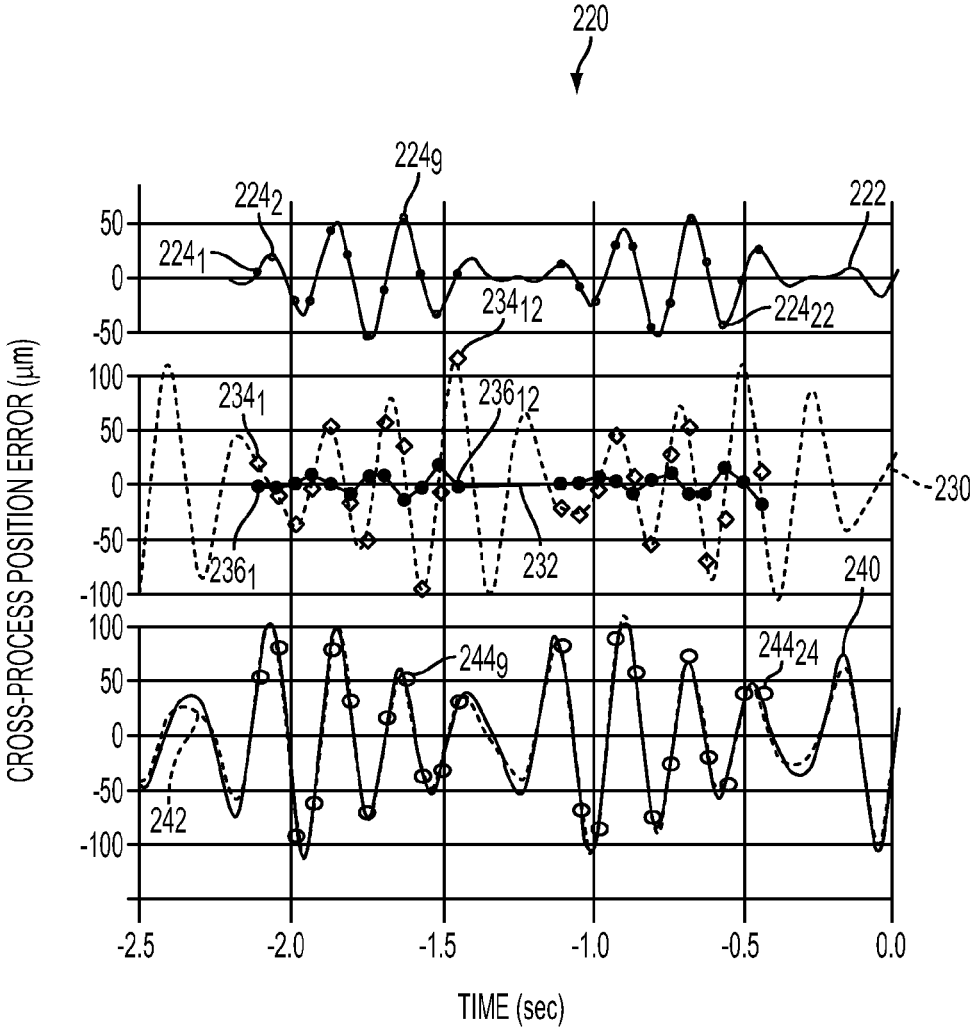
FIG. 4 depicts outputs from a model of the system of FIG. 1. showing dynamic error characterization by the system, dynamic error correction by the system, and robustness in the control of the system when errors are introduced into the control process.

Results 220 of the modeling of the system 100 are shown in FIG. 4 wherein the x-axis identifies the time with respect to sensing of data by the IOWA sensor 128 at T=0.0 in seconds and the y-axis is the cross-process error caused by cross-process movement of the web 154. The results 220 include a compensating signal curve 222. The compensating signal curve 222 was obtained by performing a least squares fit of twenty-four data points $\mathbf{224}_x$ using three frequencies, each frequency associated with one of the 340 mm, 420 mm, and 550 mm circumferences discussed above.

Each of the data points $\mathbf{224}_x$ is associated with a respective print unit. The data point $\mathbf{224}_1$ is associated with a mark that was generated by the print unit 144, the data point $\mathbf{224}_2$ is associated with a mark that was generated by the print unit 146, and so on. The data points $\mathbf{224}_x$ reflect the cross-process error observed in the associated marks and the time that the mark was generated. For example, the data point $\mathbf{224}_9$ indicates that a mark was generated by an associated print unit in the print module 106 about 1.6 seconds before the mark was sensed by the IOWA sensor 128 and that the mark exhibited a 50 micron cross-process error. The correlation between the dynamic error curve 222 and the data points $\mathbf{224}_x$ indicates that procedure 180 accurately characterizes the dynamic error caused by cross-process movement of the web 154.

The results 220 further include a compensating signal curve 230 and a net error curve 232. The compensating signal curve 230 was obtained by performing a least squares fit of twenty-four data points $\mathbf{234}_x$ using the three frequencies associated with the 340 mm, 420 mm, and 550 mm circumferences discussed above. Each of the data points $\mathbf{234}_x$ is associated with a respective print unit. To test the robustness of the system, a phase error of 0.2% was introduced into the compensating signal curve 230.

The modified compensating signal curve 230 was then used to control the cross-process position of the print units using the procedure 180 and the print units were controlled to generate a validation registration pattern. The data points $\mathbf{236}_x$ reflect the cross-process error observed in the associated validation marks and the time that the validation mark was generated. The difference between the compensating signal curve 230 and the net error curve 232 is indicative of the extent to which cross-process error has been reduced.

The results 220 also include a compensating signal curve 240 and an actual error curve 242. The compensating signal curve 230 was obtained by performing a least squares fit of twenty-four data points $\mathbf{244}_x$ using the three frequencies associated with the 340 mm, 420 mm, and 550 mm circumferences discussed above. Each of the data points $\mathbf{224}_x$ is associated with a respective print unit. To test the robustness of the system, measurement noise with a standard deviation of 7.0 microns was introduced into the cross-process position of the points $\mathbf{244}_x$. The difference between the compensating signal curve 240 and the actual error curve 242 indicates that errors introduced by noise are less significant than frequency errors.

Figure 5:
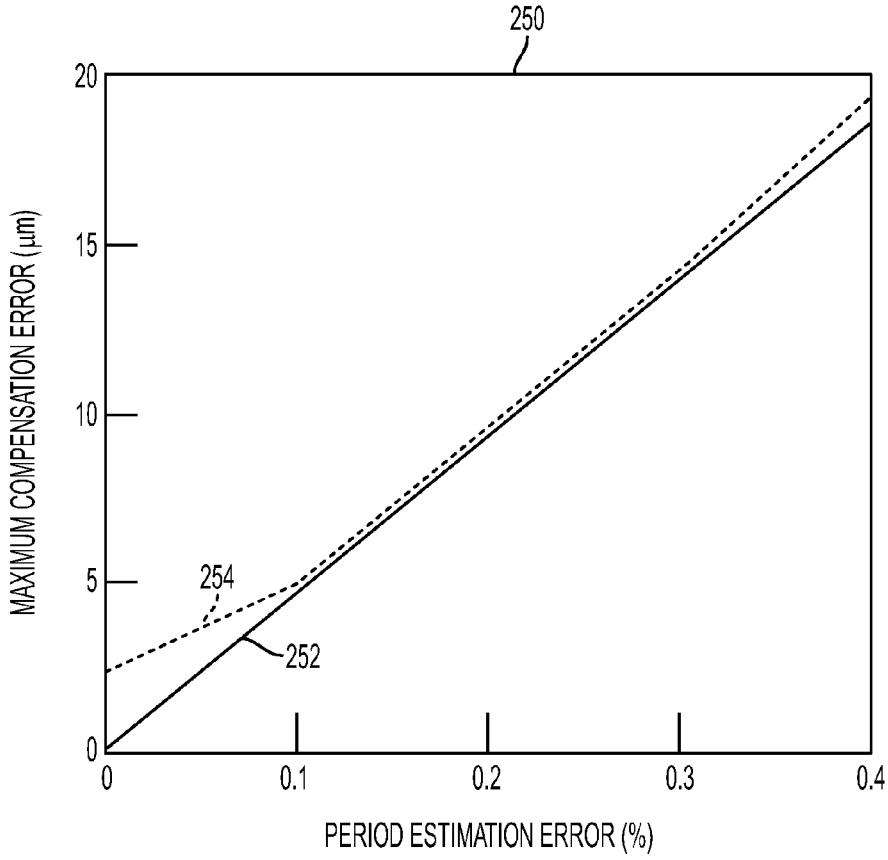
FIG. 5 depicts a plot of the maximum compensation error of the procedure of FIG. 3 as a function of the error in estimating the frequency associated with a roll.

Accordingly, the effect of frequency errors was quantified and the results are shown in the plot 250 of FIG. 5. Plot 250 includes error curve 252 and error curve 254. The error curve 252 shows the maximum compensation error as the period estimation error (phase error) increases from 0 to 0.4%. The error curve 254 shows the maximum compensation error as the period estimation error (phase error) increases from 0 to 0.4% when noise with a standard deviation of 5.0 microns was introduced into the cross-process position measurement. From the plot 250, dynamic compensation of less than 20 microns optimum dynamic compensation is realized when the phase error is maintained at 0.4% or less.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art, which are also intended to be encompassed by the following claims.

What is claimed is:

1. A method of controlling cross-process location of print heads in a print system, comprising:

identifying a first roll error frequency related to a circumference of a first roll defining a process path of a web;

identifying a first roll error phase with respect to a reference location along a process path;

identifying a first roll error amplitude of cross-process motion;

identifying a second roll error frequency related to a circumference of a second roll defining the process path of the web;

identifying a second roll error phase with respect to the reference location;

identifying a second roll error amplitude of cross-process motion; and controlling the cross-process position of a first print head and a second print head based upon the identified first roll error frequency, first roll error phase, first roll error amplitude, second roll error frequency, second roll error phase, and second roll error amplitude, wherein the first print head is axially spaced apart from the second print head along the process direction of the process path.

2. The method of claim 1, further comprising:

controlling the first print head to form a first mark upon the web moving along the process path;

controlling the second print head to form a second mark upon the web at a location adjacent to the first mark on a first cross-process axis of the web;

detecting the first mark and the second mark; and performing a first least squares fit of data associated with the detected first mark and the detected second mark, wherein identification of the first roll error phase is based upon the first least squares fit, and identification of the first roll error amplitude is based upon the first least squares fit.

3. The method of claim 2, wherein performing the first least squares fit comprises performing a first least squares fit of dynamic vibration data derived from the detected first mark and the detected second mark.

4. The method of claim 2, wherein controlling comprises:

determining a cross-process correction for the first print head based upon the location of the first print head along the process path; and determining a cross-process correction for the second print head based upon the location of the second along the process path.

5. The method of claim 4, wherein:

the first print head is within a first print unit; and the second print head is within a second print unit.

6. The method of claim 5, wherein:

the first print head is within a first print module; and the second print head is within a second print module.

7. The method of claim 2, further comprising:

controlling the first print head to form a third mark upon the web;

controlling the second print head to form a fourth mark upon the web at a location adjacent to the third print head mark on a second cross-process axis on the web;

detecting the third mark and the fourth mark;

performing a second least squares fit of data associated with the detected third mark and the detected fourth mark; and changing the controlled cross-process position of the first print head and the second print head based upon the second least squares fit.

8. The method of claim 2, wherein:

controlling the first print head comprises controlling the first print head to form the first mark at an interdocument zone of the web; and controlling the second print head comprises controlling the second print head to form the second mark at the inter-document zone.

9. A printing system comprising:

a first roll with a first circumference positioned along a process path;

a second roll with a second circumference positioned along the process path, the second circumference different from the first circumference;

a first print head positioned adjacent to the process path;

a second print head positioned adjacent to the process path and axially spaced apart from the first print head along an in-track axis of the process path;

a sensor positioned along the process path;

a memory in which command instructions are stored; and a processor configured to execute the command instructions to characterize the cross-process movement of a web moving along the in-track axis of the process path by (i) identifying a first roll error ($R_e$) associated with the first roll, (ii) identifying a second $R_e$ associated with the second roll, and (iii), calculating the cross-process web motion from the first roll error and the second roll error, control the cross-process position of the first print head based upon the calculated cross-process web motion, and control the cross-process position of the second print head based upon the calculated cross-process web motion.

10. The printing system of claim 9, wherein the processor is further configured to execute the command instructions to:

control the first print head to form a first mark upon the web;

control the second print head to form a second mark upon the web at a location adjacent to the first mark on a first cross-process axis of the web;

detect the first mark and the second mark; and perform a first least squares fit using the detected first mark and the detected second mark in calculating the cross-process web position.

11. The system of claim 10, wherein the processor is further configured to execute the command instructions to:

perform the first least squares fit based upon a third detected mark.

12. The system of claim 10, wherein the processor is further configured to execute the command instructions to:

determine a cross-process correction for the first print head based upon the location of the first print head along the in-track axis of the process path; and determine a cross-process correction for the second print head based upon the location of the second print head along the in-track axis of the process path.

13. The system of claim 12, wherein:

the first roll is a leveler roll; and the second roll is a pre-heater roll.

14. The system of claim 12, wherein:

the first print head is within a first print module; and the second print head is within a second print module.

15. The system of claim 12, wherein the processor is further configured to execute the command instructions to:

control the first print head to form a third mark upon the web;

control the second print head to form a fourth mark upon the web at a location adjacent to the third mark on a second cross-process axis on the web;

detect the third mark and the fourth mark;

perform a second least squares fit of data associated with the detected third mark and the detected fourth mark; and change the controlled cross-process position of the first print head and the second print head based upon the second least squares fit.

16. A method of controlling a plurality of ink print heads, comprising:

identifying a first cross-process error associated with the location of a first mark in a registration pattern on a web moving along a process path;

identifying a second cross-process error associated with the location of a second mark in the registration pattern;

identifying a first roll frequency associated with a first roll positioned along the process path;

identifying a second roll frequency associated with a second roll positioned along the process path;

performing a first least squares fit analysis using the first roll frequency, the second roll frequency, the first cross-process error, and the second cross-process error to identify a compensation signal based upon a first roll error ($R_e$) associated with the first roll and a second roll error ($R_e$) associated with the second roll; and controlling the cross-process position of a first print head and a second print head based upon the identified compensation signal, wherein the first print head is axially spaced apart from the second print head along the in-track axis of the process path.

17. The method of claim 16, wherein controlling comprises:

controlling the cross-process position of the first print head based upon the location of the first print head along the in-track axis of the process path; and controlling the cross-process position of the second print head based upon the location of the second print head along the in-track axis of the process path.

18. The method of claim 17, wherein:

the first print head is within a first print unit; and the second print head is within a second print unit.

19. The method of claim 17, further comprising:

controlling the first print head to form the first mark;

controlling the second print head to form the second mark at a location adjacent to the first mark on a first cross-process axis on the web.

20. The method of claim 19, further comprising:

controlling the first print head to form a third mark;

controlling the second print head to form a fourth mark at a location adjacent to the third mark on a second cross-process axis on the web;

detecting the third mark and the fourth mark;

performing a second least squares fit of data associated with the detected third mark and the detected fourth mark; and changing the controlled cross-process position of the first print head and the second print head based upon the second least squares fit.

* * * * *